US006089136A

United States Patent [19]

Hinojosa et al.

[11] Patent Number: 6,089,136

[45] **Date of Patent: *Jul. 18, 2000**

[54] MEDIA CONTROL TECHNIQUE FOR CUTTING OPERATION ON A PRINTER

[75] Inventors: Antonio Hinojosa, Rubi; Joaquim Brugue, Barcelona, both of Spain

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,229

[22] Filed: Sep. 2, 1997

Related U.S. Application Data

[63] Continuation-in-part of application No. 08/646,693, Apr. 29, 1996, Pat. No. 5,881,624.

[51] Int. Cl.[7] ..... B26D 1/18

[52] U.S. Cl. ..... 83/453; 83/488; 83/614

[58] Field of Search ..... 83/485, 487, 488, 83/497, 578, 614, 496, 453

[56] References Cited

U.S. PATENT DOCUMENTS

| | | | |
|---|---|---|---|
| 329,865 | 11/1885 | Sweeney et al. . | |
| 559,179 | 4/1896 | Koegel . | |
| 2,631,669 | 3/1953 | Baker | 83/485 X |
| 3,463,040 | 8/1969 | Pouilloux | 83/487 X |
| 3,686,991 | 8/1972 | Fujimoto | 83/614 X |
| 3,762,259 | 10/1973 | Kuts | 83/488 X |
| 4,691,605 | 9/1987 | Vanetik et al. | 83/485 X |
| 5,042,349 | 8/1991 | Komatsu | 83/488 X |
| 5,307,716 | 5/1994 | Onishi et al. | 83/488 |
| 5,421,185 | 6/1995 | Castricum | 83/487 X |
| 5,503,053 | 4/1996 | Onishi et al. | 83/488 |
| 5,873,293 | 2/1999 | Yamazaki | 83/497 |
| 5,881,623 | 3/1999 | Otani et al. . | |
| 5,881,624 | 3/1999 | Brugue et al. | 83/614 |
| 5,904,085 | 5/1999 | Onishi et al. . | |

FOREIGN PATENT DOCUMENTS

| | | | |
|---|---|---|---|
| 2389300 | 12/1978 | France | 83/508 |

*Primary Examiner*—Kenneth E. Peterson

[57] ABSTRACT

A cutter assembly which traverses across a media path to make a linear cut on the media includes a pair of cooperative rotary cutting blades. An upper rotary blade is mounted for passive rotation while a lower rotary blade is directly coupled to a lower drive wheel which engages the undersurface of a media guide member. The blades are slightly overlapping at their peripheral edges, with the lower blade in a fixed position, and the upper blade spring biased in an axial direction against the lower blade. An additional media-contacting wheel is mounted on the cutter assembly to be substantially vertically aligned with the lower drive wheel, and is spring biased downwardly toward the uppersurface of the media guide member in order to assure constant rotational engagement of the lower drive wheel with the media guide member during cutting. The lower drive wheel and lower rotary blade are coaxially mounted at a slight angular declination facing upstream as compared to the direction of traverse of the cutter assembly. The media-contacting wheel is also mounted on the cutter assembly at a similar slight angular declination. Such angles of declination create a pull on the media as it moves toward the two rotary cutting blades, thereby preventing undesirable media slack.

13 Claims, 10 Drawing Sheets

MEDIA CONTROL TECHNIQUE FOR CUTTING OPERATION ON A PRINTER

This application is a continuation-in-part of commonly assigned application Ser. No. 08/646,693 filed by Joaquim Brugue, et al. on Apr. 29, 1996 entitled MEDIA CUTTING APPARATUS AND METHOD, now issued as U.S. Pat. No. 5,881,624, which is incorporated herein by reference.

Printers often provide a cutter which can be used to cut the media without having to remove the media from the printer. This is particularly desirable in large format printers which typically have rollfeed media. Conventional cutters have been mounted on large format printers for either automated or manual actuation to pass a cutting blade across the media after a printing operation is completed. Since rotary cutting blades have been used in conjunction with fixed linear blades on the printer, and various techniques have been used to hold the media in position during a cutting operation. However, such prior cutters have either been overly expensive and complicated, or have not provided precise and reliable cutting of the media.

Accordingly, there is a need for a simplified cutter that provides automated cutting using a self-contained cutter assembly which employs rotary blades and rotating wheels to traverse across printed media while providing a satisfactory cutting operation.

BRIEF SUMMARY OF THE INVENTION

A cutter assembly which traverses across a media path to make a linear cut on the media includes a pair of cooperative rotary cutting blades. An upper rotary blade is mounted for passive rotation while a lower rotary blade is directly coupled to a lower drive wheel which engages the undersurface of a media guide member. The blades are slightly overlapping at their peripheral edges, with the lower blade in a fixed position, and the upper blade spring biased in an axial direction against the lower blade. An additional media-contacting wheel is mounted on the cutter assembly to be substantially vertically aligned with the lower drive wheel, and is spring biased downwardly toward the upper surface of the media guide member in order to assure constant rotational engagement of the lower drive wheel with the media guide member during cutting. The lower drive wheel and lower rotary blade are coaxially mounted on the same axle in a slight angular declination facing upstream as compared to the direction of traverse of the cutter assembly. The media-contacting wheel is also mounted on the cutter assembly at a similar sight angular declination. Such angles of declination create a pull on the media as it moves toward the rotary cutting blades, thereby preventing undesirable media slack.

DETAILED DESCRIPTION OF THE EXEMPLARY EMBODIMENTS

Figure 1:
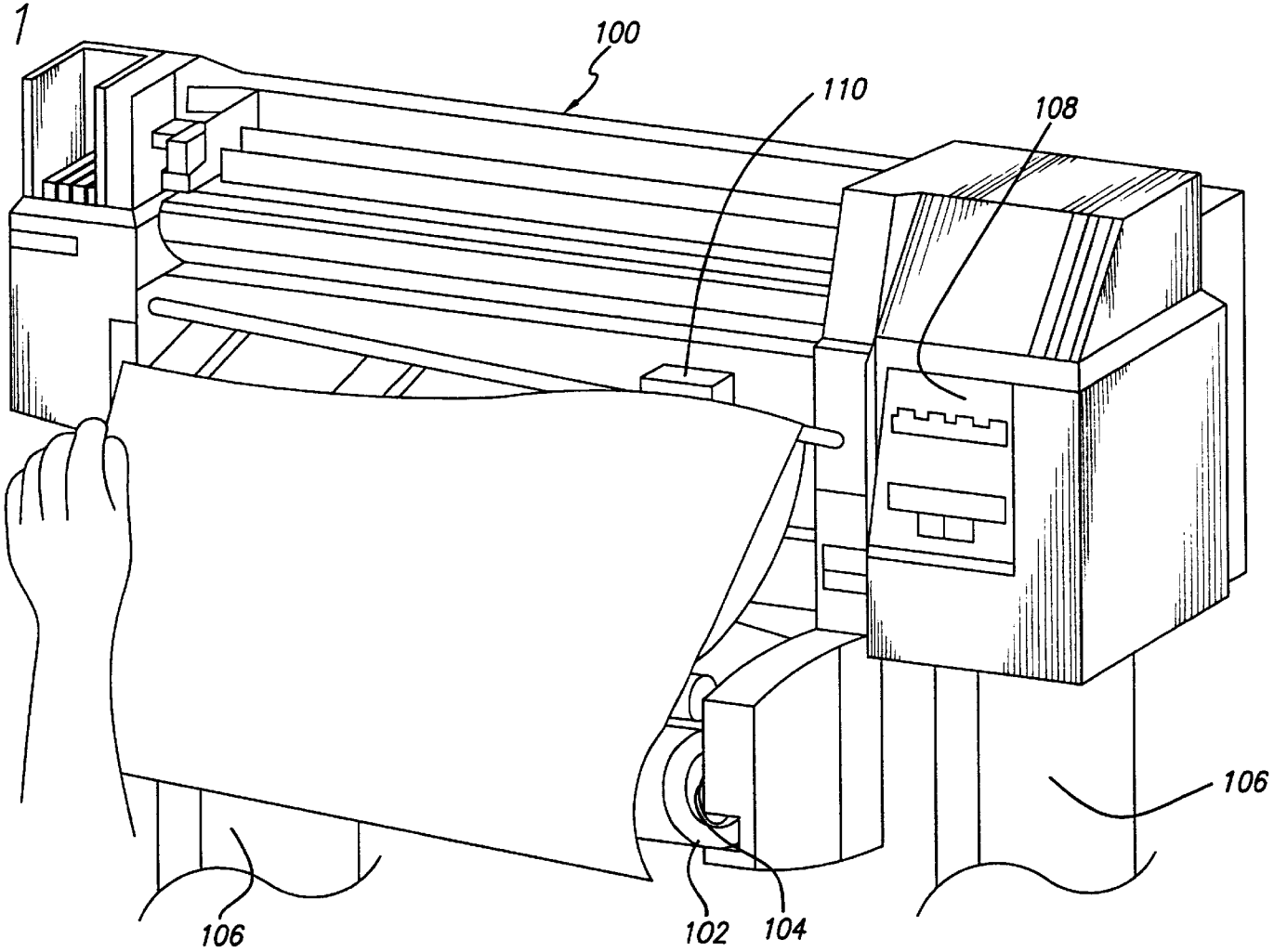
FIG. 1 is a perspective view showing a rollfeed printer incorporating a first embodiment of a cutter apparatus which has been manually moved from left to right to cut off a section of media which has passed through a print zone of the printer.

The invention of the present application operates in conjunction with a printer 100, FIG. 1, which typically carriers rollfeed media 102 mounted on a spindle 104 and supported by a set of legs 106. There are also some rollfeed printers which may be positioned to rest on a table, such as shown in copending commonly assigned Ser. No. 08/922,030 filed Sep. 2, 1997 in the name of Joaquim Brugue, et al. entitled REMOVABLE ROLLFEED APPARATUS FOR A DESK-MOUNTABLE PRINTER, now issued as U.S. Pat. No. 5,988,904 issued Nov. 23, 1999 which in incorporated herein by reference. The printer includes a control panel 108 having operating switches and lights to indicate its status. For illustrative purposes, hanging from the printer is a media segment such as paper, vellum or film which has just exited from the printer. Printers of the type illustrated may be purchased from Hewlett-Packard under the trademark DesignJet. These printers use inkjet technology to produce vibrant full color or monochrome outputs in dimensions large enough to handle E size prints and larger.

The printer has a cover which encloses one or more thermal inkjet cartridges mounted in a scanning carriage mounted on rods to allow the cartridges to move back and forth across a rotatable platen roller. Media moves along a path over the platen in what can be termed the X-direction while the scanning carriage moves across the media in the Y-direction.

The Hewlett-Packard DesignJet printers are intended to have media sheets fed one at a time through the printer, or alternatively to allow the option of feeding the printer from a roll of media. The rollfeed apparatus can be incorporated as part of the printer itself, or it can be installed as an optional accessory.

Figure 3:
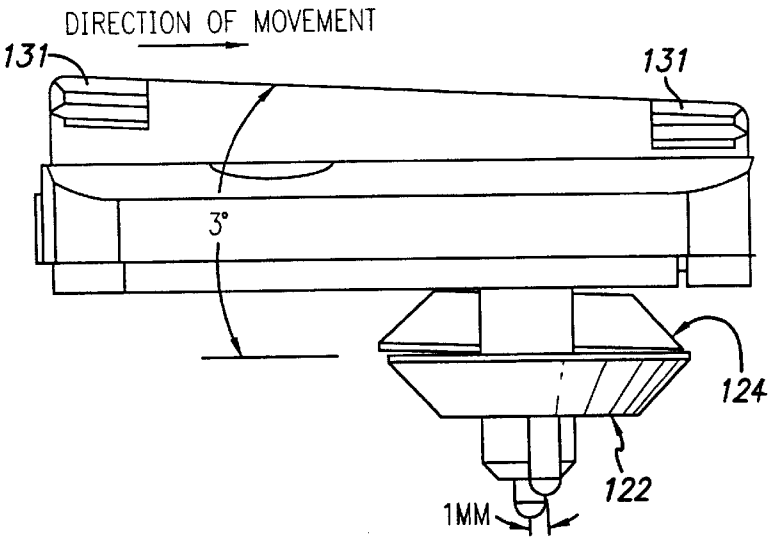
FIG. 3 is a top plan view of the interior of the cutter apparatus as shown in FIG. 2.
Figure 2:
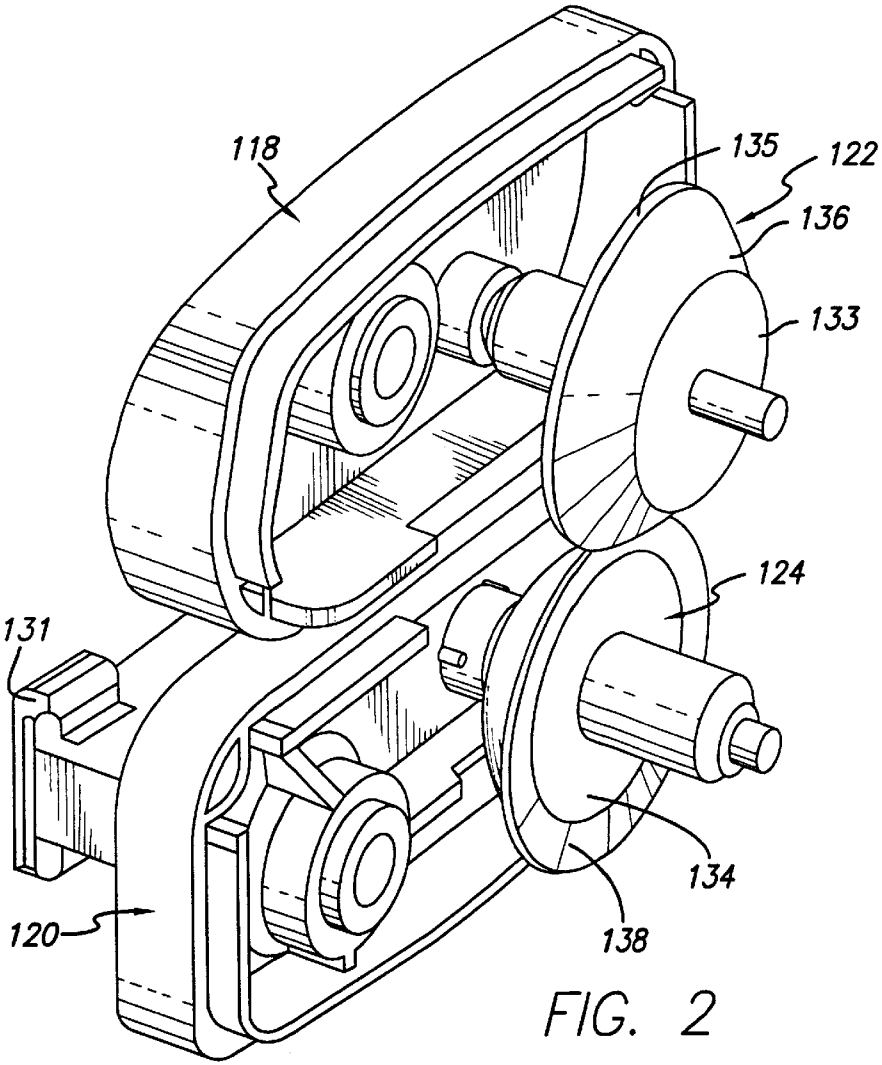
FIG. 2 is an enlarged pictorial view of the interior of the cutter apparatus of FIG. 1.
Figure 4:
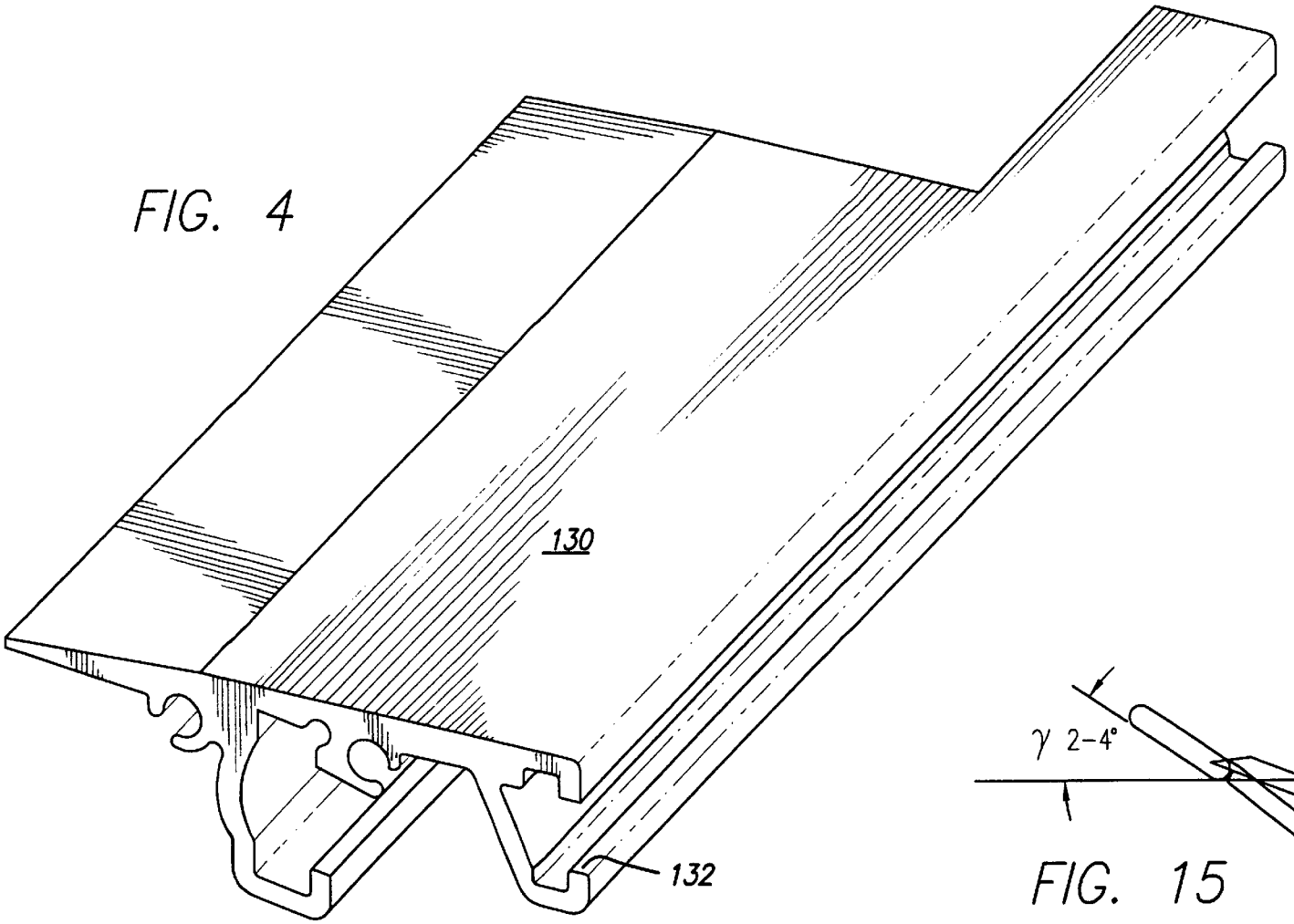
FIG. 4 is a pictorial view of a guide rail for slidably carrying the cutter apparatus of FIGS. 1–3.

Referring now to FIGS. 2 and 3, a first embodiment of the cutting apparatus 110 is shown in detail. The cutting apparatus is relatively simple, reliable and inexpensive as will be apparent from its description. It includes a housing 114 which comprises a one piece base 116, an upper cover 117 and a lower cover 120. Mounted within the housing are two slitter blades 122, 124. A coil spring is mounted within the housing and axially biases the blades together as will be described below. The spring pushes on an adjacent axial bushing 128, which is a kind of washer that pushes within a small protrusion onto the blade in a very small radius minimizing the amount of friction torque.

The cutting apparatus 110 is attached to a media output support platen 130 by guide flanges 131 which are integrally molded with the cutter housing 114 and slidably guided in the channel 132 in platen 130. When mounted, a user grips the upper portion of the housing 114 and slides the cutting apparatus 110 along the guide channel 132 so that the media to be cut is engaged by the two blades 122, 124.

An important feature of the cutting apparatus is that after being cut, the two segments of sheet media proceed along different non-parallel paths. In particular, the cutting apparatus of the embodiment of FIGS. 1–4 is designed to move from left to right across the media which exits from a print zone of the inject printer. Thus, the media enters the opening immediately in front of the blades 122, 124 is then engaged by the slitter blades, and the segment of the sheet media still attached to the roll 102 proceeds along a first passage located between the two covers 118, 120. This passage is generally linear. The segment of the media which is "cut loose" from the printer travels along a downward passage molded into an opposite side of the housing, causing the loose segment to move downwardly and away from the attached media.

As best shown in FIGS. 2–3, each cutting blade 122, 124 is in the form of a disk having a front surface 133 and a rear surface 134. Along the periphery of the disk is a beveled surface 136. This beveled surface 136 is formed at approximately a 45° angle from the plane of the front surface 133. The rear surface 134 includes a circular wedge or ramp 138 which extends at approximately 10° from the plane formed by the rear surface 134. The edge of the blade between the beveled surface 136 and the rear surface 132 is a cylindrical surface 135 having a short length of about 0.5 mm.

The upper blade 122 and lower blade 124 are disposed in opposite directions so that they engage each other as shown in the drawings with a small peripheral overlap. The angular difference between a line intermediate both blades and a corresponding line along the guide flanges 131 is a slight angular deflection of about 3°. As seen in FIG. 3 each blade of the blade pair faces upstream of the direction of media movement at a slight but different angular deflection relative to the traverse direction of the cutting apparatus 110. It should also be noted that the contact between the blades is at the front of the cutter apparatus where the media makes the first contact with the blades. All of this is to ensure a quality cut even when a difficult media like polyester is used by the printer. Because at least one of the blades is spring biased, a frictional engagement between the two blades is maintained with a predetermined force. A material to be cut is entrapped between the two blades and a shearing cut is made.

In operation, the cutter apparatus rides along the platen 130 and is normally parked at the left edge of the platen. When a user desires to cut the media which has been printed, the operator grips the media with his/her left hand as close as possible to the cutting apparatus and holds the media taut. The operator then grips the cutting apparatus with his or her thumb and index finger of the right hand and guides the cutter across the media sheet. A linear cut is made in which the new edge closest to the printer is guided through the linear passage of the cutter, whereas the sheet segment that is being separated from the printer is guided downwardly away from its original position by following the downward passage in the cutting apparatus. As previously stated, there is an offset of about 3° between the actual cutting line of the blades and the channel 132 which determines the direction of travel of the entire cutter apparatus across the media during a cutting operation.

Figure 5:
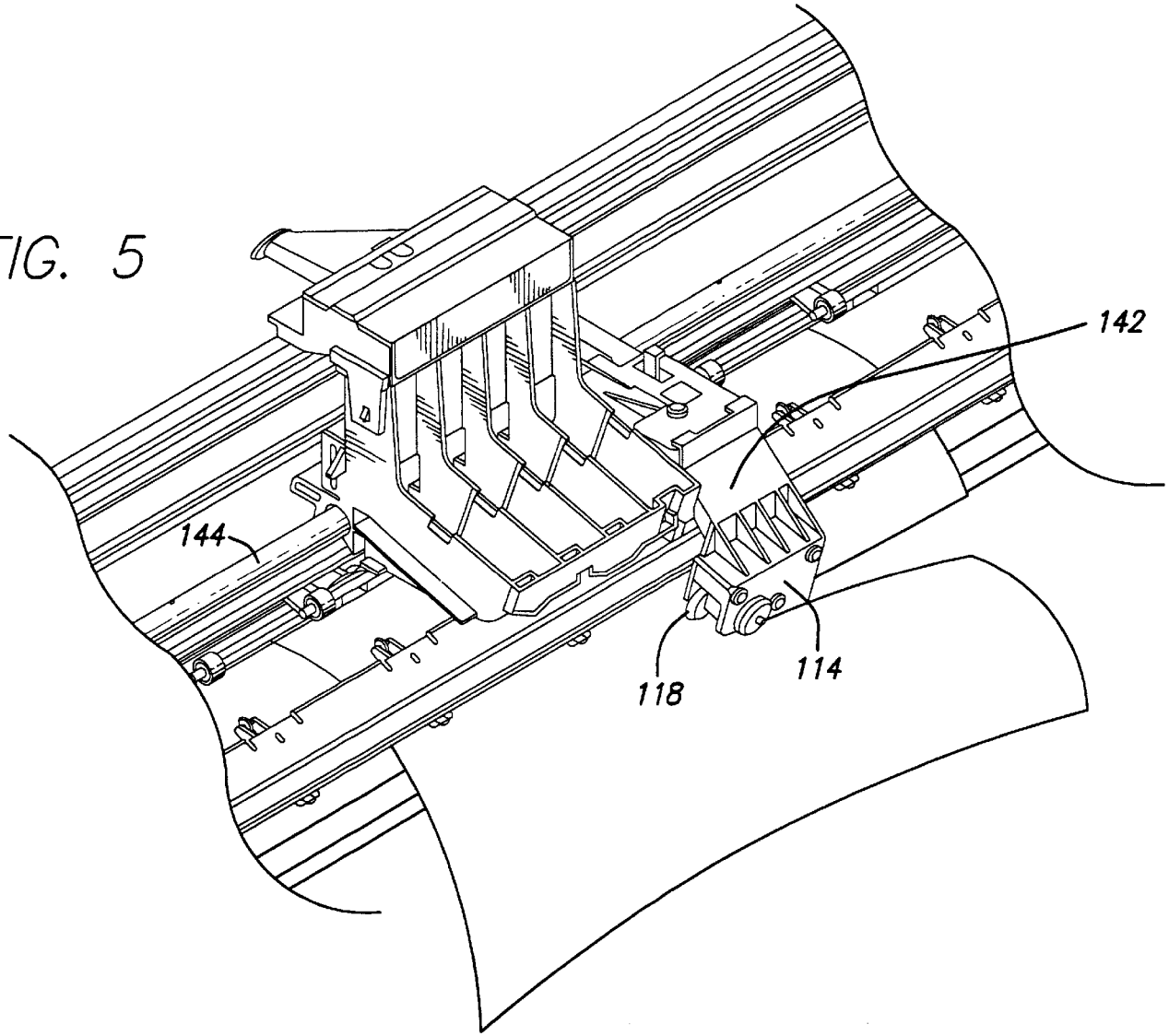
FIG. 5 is a fragmented perspective view showing a second embodiment of a cutter assembly which has been moved by a motorized printer carriage from right to left to cut off a section of media which has passed through a print zone of the printer.
Figure 8:
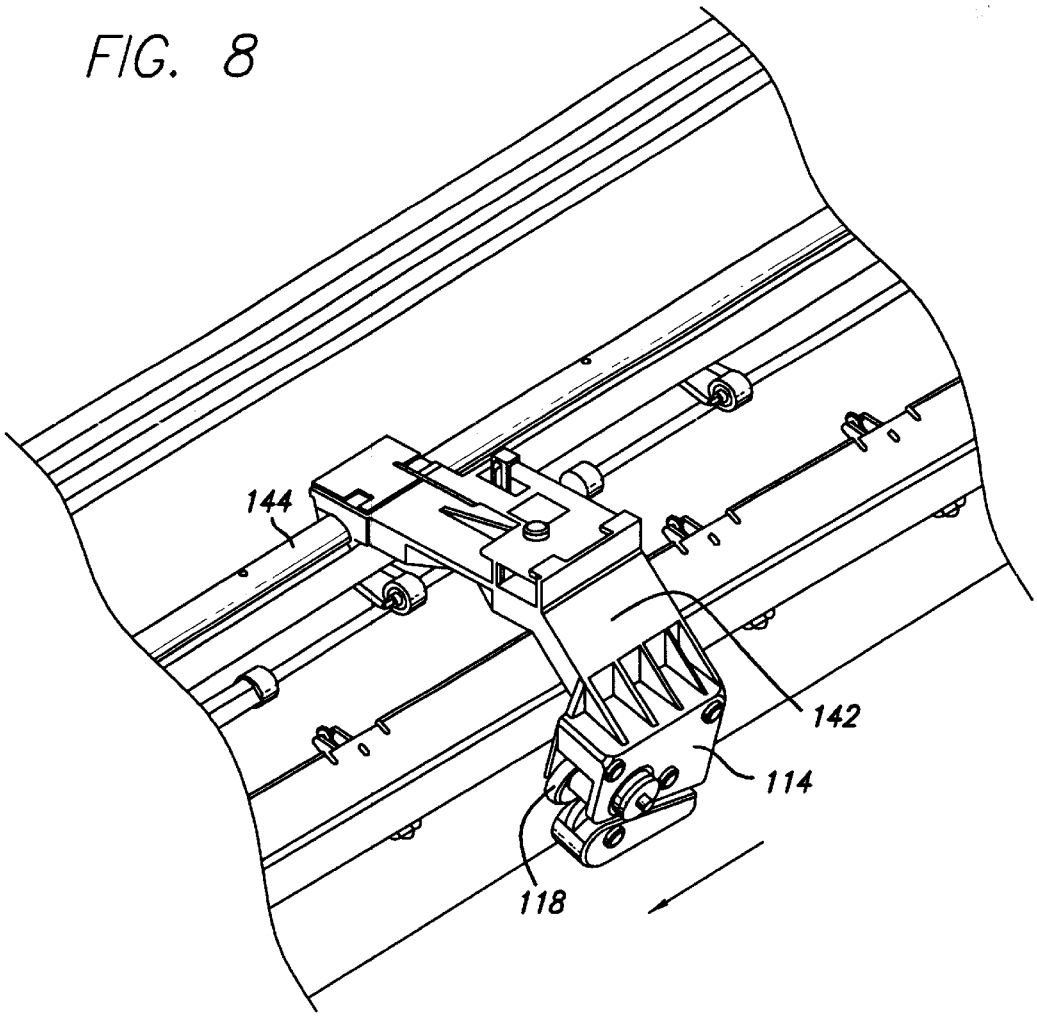
FIG. 8 is an enlarged fragmented perspective view showing the second embodiment of the cutter assembly of FIG. 5 slidably mounted on a carriage support rod.
Figure 9:
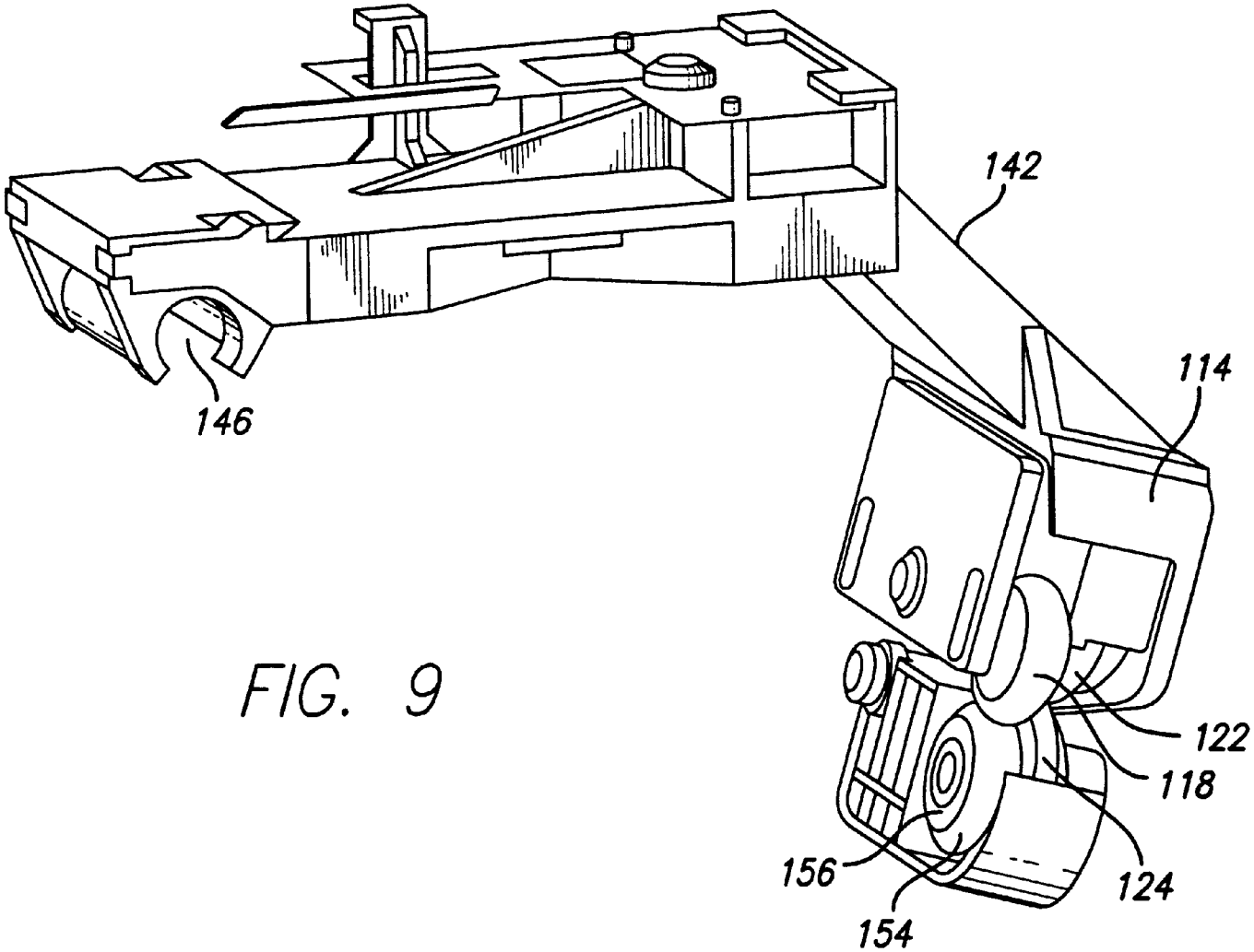
FIG. 9 is a perspective view of the cutter assembly of FIG. 5.
Figure 10:
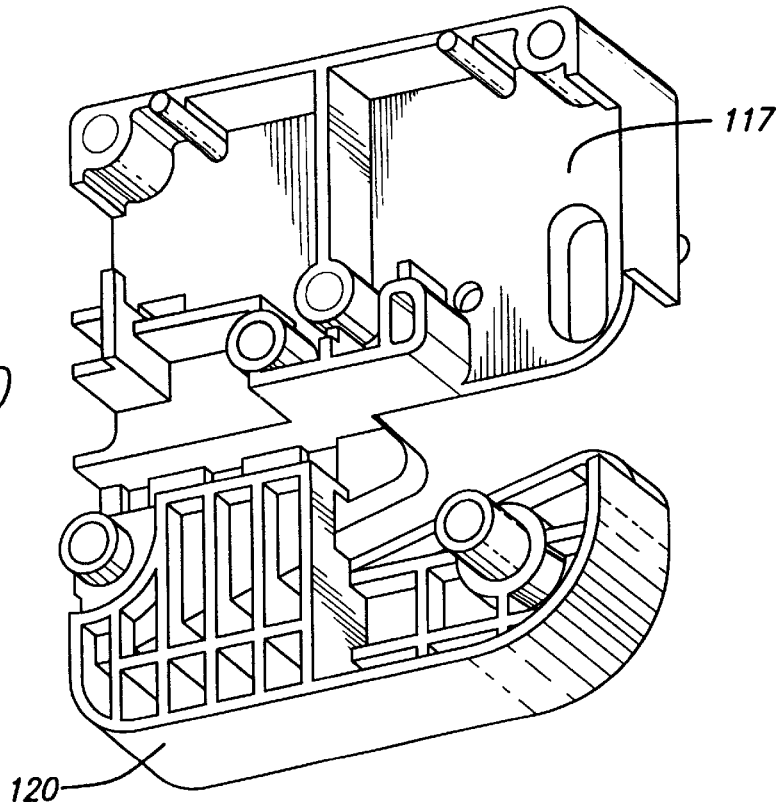
FIG. 10 is an enlarged internal view of a cutter housing without any wheels or cutting blades.
Figure 11:
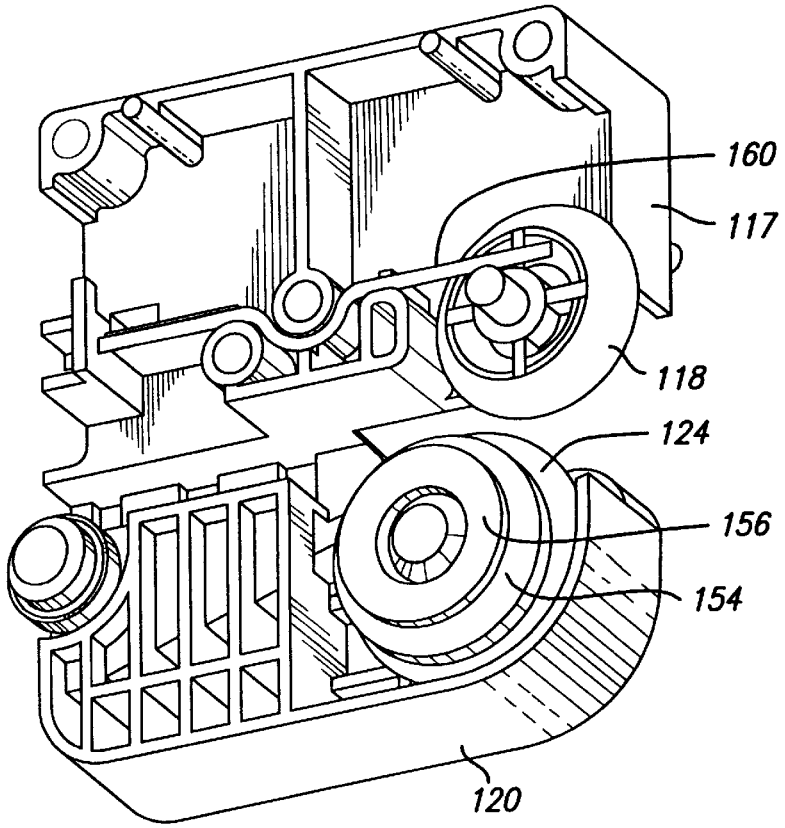
FIG. 11 shows the internal view of the cutter housing of FIG. 10 with one rotary cutting blade, three wheels and a downward biasing spring mounted therein.
Figure 12:
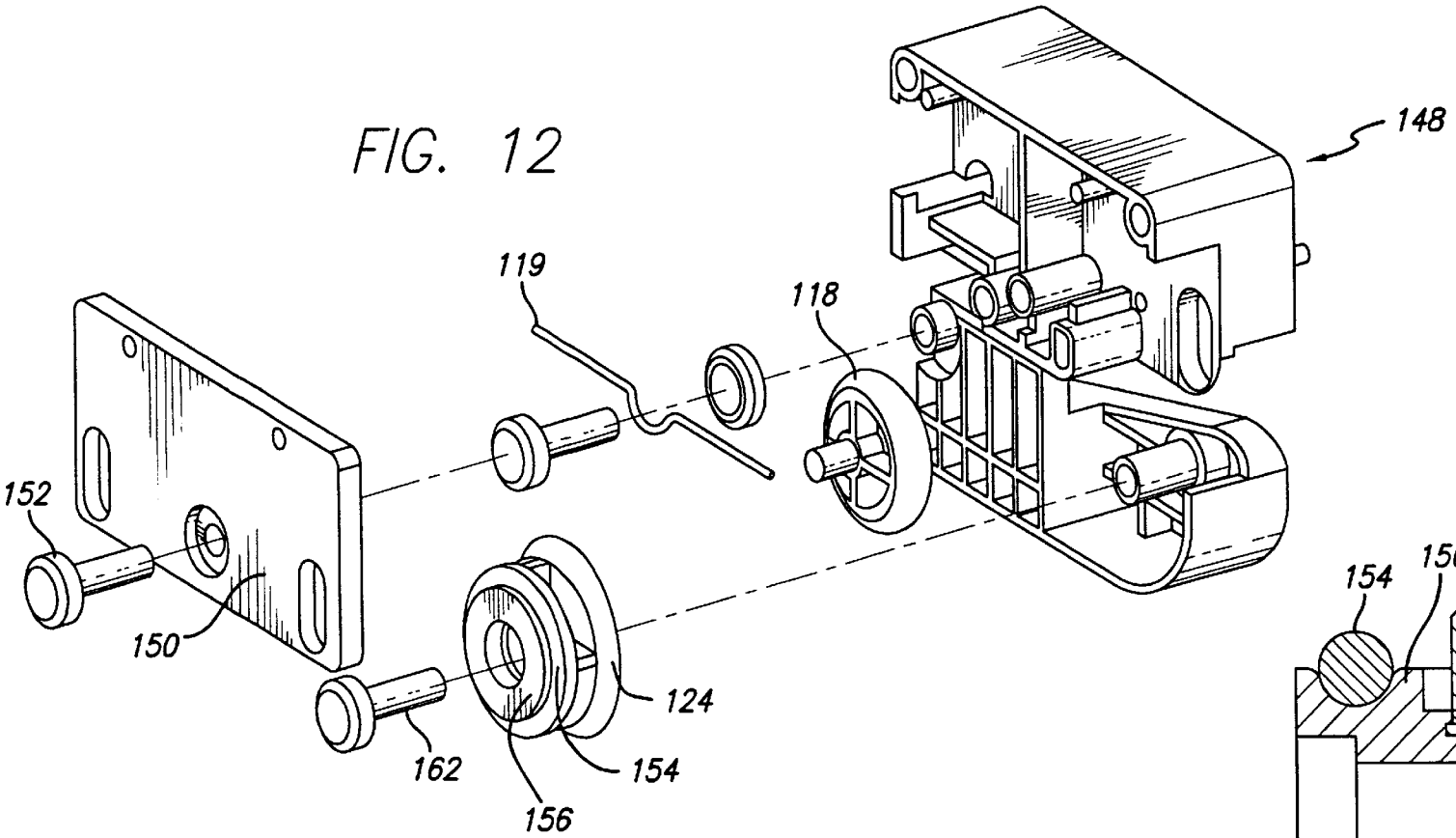
FIG. 12 shows an exploded view of FIG. 11 with a head cover and mounting screws included.
Figure 13:
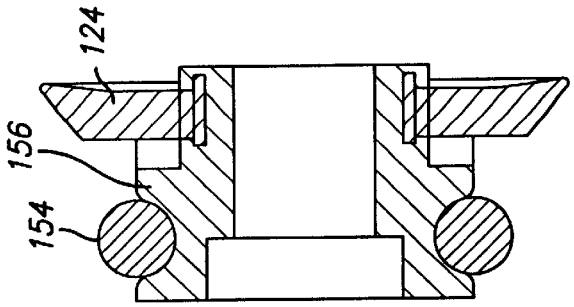
FIG. 13 is a partial sectional view of a combined drive wheel/rotary cutter.
Figure 14:
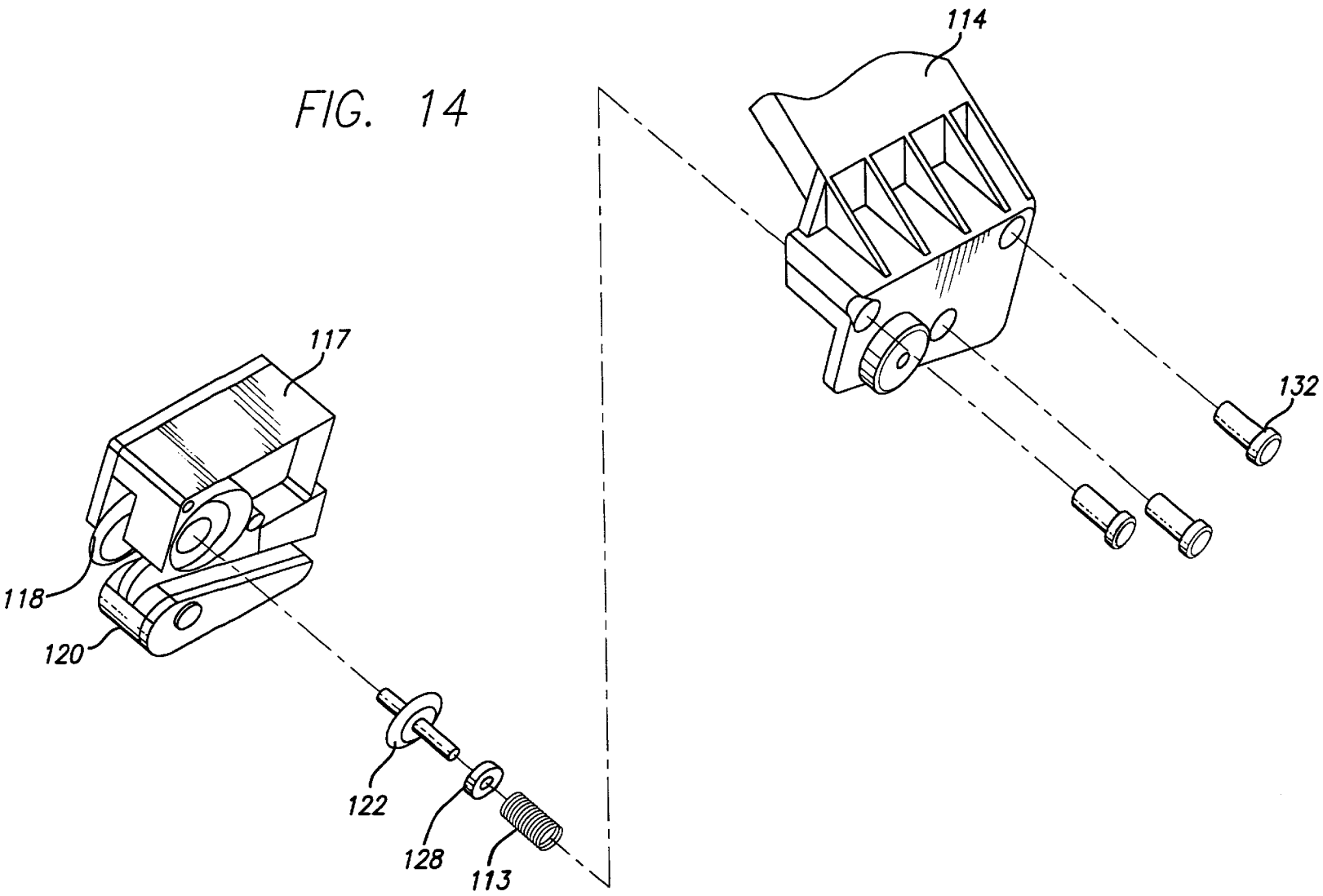
FIG. 14 is an exploded view showing how the components of FIG. 12 are attached with a second rotary cutter to one end of a cutter arm.

FIGS. 5, 8 and 9 show the details of the fully operating cutter assembly which is retrieved from a parking position by the carriage in a manner previously implemented in the previous DesignJet large format printer.

Figure 7:
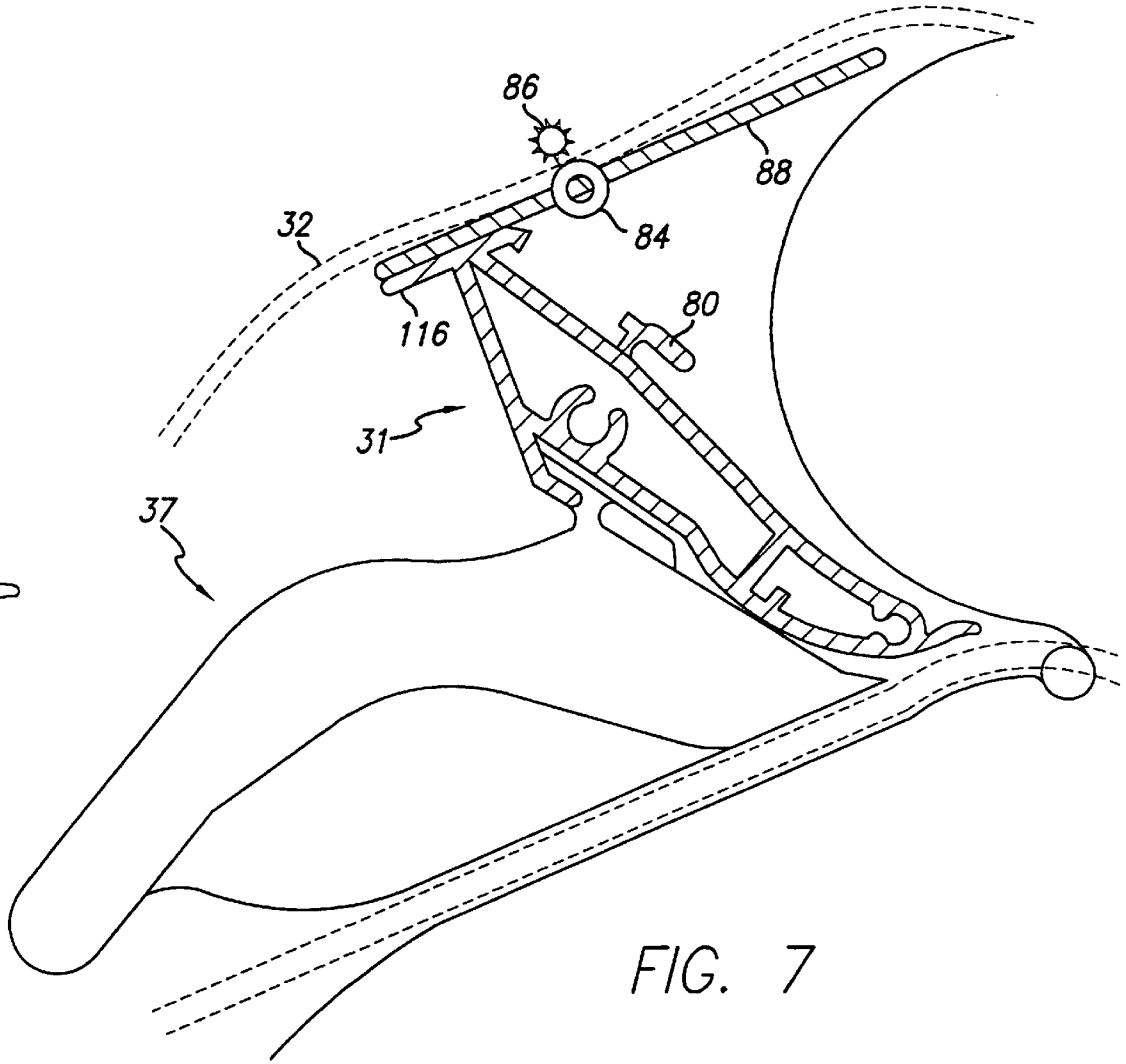
FIG. 7 is a partial sectional view showing the guide platen of FIG. 6 integrated with the input and output paths for media passing through the printer.
Figure 6:
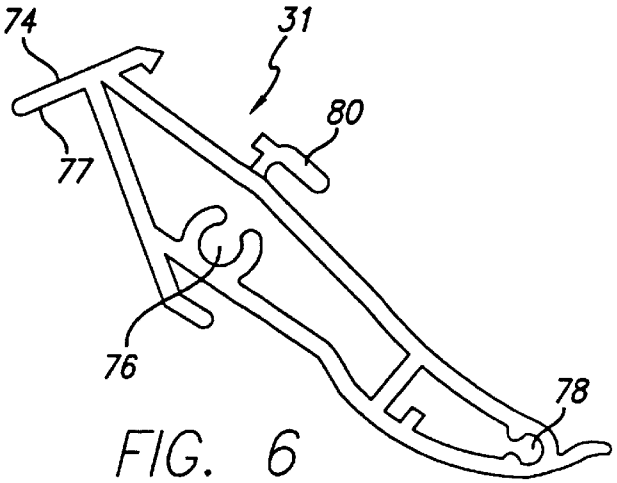
FIG. 6 is a right end view of a guide platen for the cutter assembly shown in FIG. 5.

FIGS. 6–7 shown the details of the media 31, including an output platen 74, central and bottom mounting screw holes 76, 78 and rear mounting slot 80 for hanging on right and left printer frame pins (not shown). The output path may include output rollers 84, star wheels, 86, and a flexible mylar paper separator 88.

FIGS. 10–14 show the details of the mounting of cutter blades and wheels within the casing and housing components of the cutter assembly.

Figure 15:
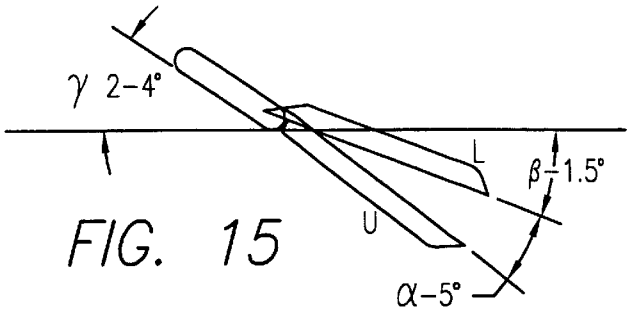
FIG. 15 is a schematic diagram showing preferred angles of inclination for the rotary cutting blades.

FIGS. 15A and 15B show the specific angular declinations of the cutter blades 122, 124 and wheel 118. In that regard, the amount of overlap between the two rotary cutter blades determines the angle of deflection of the cut media passing from the cutter assembly, which in the preferred embodiment is approximately 13 degrees. As seen in FIG. 15A the lower blade 124 is angled at a slight angle of about 1.5° with respect to the direction of movement of the cutter assembly and the upper blade 122 is angled at about 5° relative to the lower blade 124, i.e. a more appreciable angle of declination. The media hold down wheel 118 is mounted such that its direction of rotation faces upstream (of the direction of media travel) at a slight angle of declination of between 2–4° (FIG. 15B). The angle of declination of cutter 124 and wheel 118 may therefore be approximately the same and each being less than about 10°, preferably between 1° and 10°.

Figure 16:
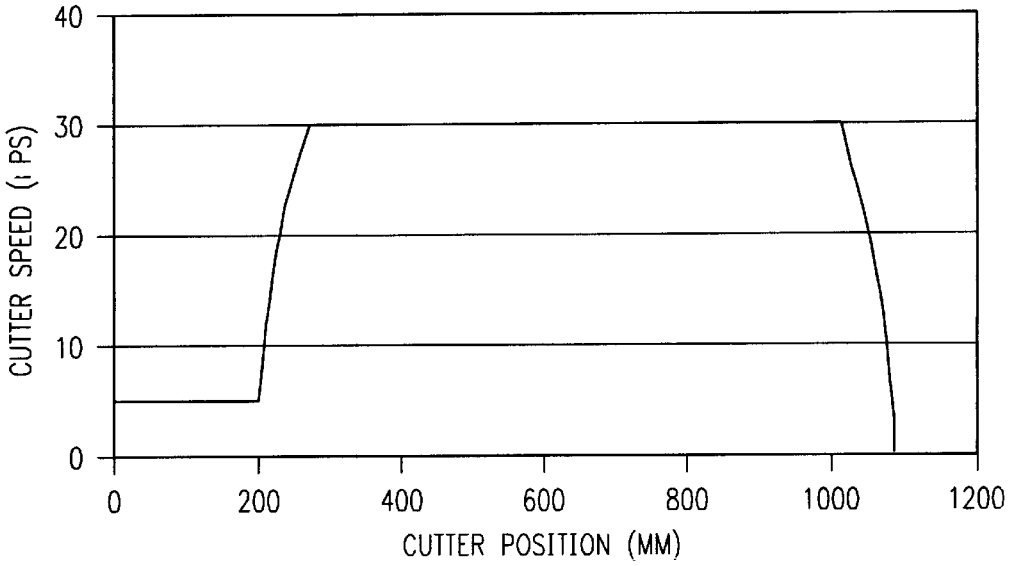
FIG. 16 is a graph showing preferred traversing speeds for the cutter assembly during a cutting operation.

FIG. 16 shows that a preferred initial translational speed of the cutter assembly at the time of first encountering the media to be cut is 5 ips, while thereafter the preferred speed through the rest of the cutting operation is 3 ips.

It will be understood from the drawings that the cutter arm 142 rides on the same slider rod 144 as the carriage through bushing 146, and carries cutter components lower driven tire 104 having a central wheel 106 and concentric driven rotary blade 124, as well as upper rotary blade 122 which is biased by spring 113 against the driven blade 124. An additional media hold down wheel or positional tire 118 is provided which rides on the output platen 74 which has an undersurface 116 which is textured to assure maintenance of the proper frictional contact with the drive tire 104. The upper tire 118 is biased by spring 120 which is mounted along with the other aforesaid components in housing 148. A side plate 150 and related mounting screws 152 provide attachment and bearing functions for the various components. Biasing spring 113 acts against the second rotary blade 124 by virtue of additional mounting screws 132.

It will therefore be appreciated by those skilled in the art that a compact yet sophisticated cutter assembly is provided for manual or preferably automated cutting of media in a printed, all as set forth in the following claims.

We claim as our invention:

1. A cutter assembly for cutting printed media during movement across a media path in a traverse direction comprising: a support; a first and a second rotary cutting blade carried on said support, said first cutting blade having first and second sides and a peripheral cutting edge which lies in a first cutting plane, said first blade being mounted for rotation such that said first cutting plane makes a first acute angle relative to a cutter traverse direction and said second side of said first blade faces generally in the direction of media movement, and said second cutting blade having first and second sides and a peripheral cutting edge which lies in a second cutting plane, said peripheral edges of said blades being engageable with each other, said second blade being mounted for rotation such that said second cutting plane makes a second acute angle relative to said cutter traverse direction and said second side of said second blade faces generally opposite to the direction of media movement, said first acute angle being less than said second acute angle.

2. The cutter assembly of claim 1, wherein said first one of said rotary cutting blades is generally below the printed media, and said second one of said rotary cutting blades is generally above the printed media.

3. The cutter assembly of claim 2, wherein one of said rotary cutting blades is coupled to a blade drive wheel.

4. The cutter assembly of claim 3, wherein said blade drive wheel is located below the printed media.

5. The cutter assembly of claim 4, wherein said blade drive wheel is mounted in a fixed position on said support.

6. The cutter assembly of claim 5, wherein said rotary cutting blades partially overlap at their peripheral edges.

7. The cutter assembly of claim 3, wherein said blade drive wheel is coaxial with said one rotary cutting blade to which it is coupled.

8. The cutter assembly of claim 3, which further includes a media-contact wheel on said support which is disposed in a plane which makes a third acute angle with respect to said traverse direction.

9. The cutter assembly of claim 1, further comprising a cutter drive for moving said cutter assembly across the media path.

10. The cutter assembly of claim 9, wherein said cutter drive comprises an arm on said support coupled to a printer carriage.

11. A printer and media cutter assembly for cutting rollfeed media subsequent to passage of media through a print zone to a cutting zone located downstream from the print zone, said printer including an output platen located adjacent to the printing zone and said cutter assembly being transversely moveable across the media path, said cutter assembly comprising a support; a first rotary cutting blade mounted on said support and having first and second sides and a peripheral cutting edge which lies in a first cutting plane, said first blade being mounted for rotation such that said first cutting plane makes a first acute angle relative to a cutter traverse direction and said second side of said first blade faces generally in the direction of media movement, and said second cutting blade having first and second sides and a peripheral cutting edge which lies in a second cutting plane, said second blade being mounted for rotation such that said second cutting plane makes a second acute angle relative to said cutter traverse direction and said second side of said second blade faces generally opposite to the direction of media movement, said cutting edges being engageable with each other; and a first wheel mounted on said support for holding the media in secure position against said output platen during a cutting operation, said wheel mounted for rotation in a plane which intersects said lateral direction at a third acute angle which is equal to or greater than said first acute angle.

12. The printer of claim 11, wherein said first angle and said third angle are each less than ten degrees.

13. The printer of claim 11, wherein said first angle and said third angle are each in the range of one through ten degrees.

* * * * *